United States Patent [19]

Khoury

[11] 4,061,243

[45] Dec. 6, 1977

[54] END CLOSURE WITH VARIABLE SIZE POUR OPENING

[75] Inventor: Nick S. Khoury, Worth, Ill.

[73] Assignee: The Continental Group, Inc., New York, N.Y.

[21] Appl. No.: 737,960

[22] Filed: Nov. 2, 1976

[51] Int. Cl.[2] ..... B65D 41/32

[52] U.S. Cl. ..... 220/269; 220/270

[58] Field of Search ..... 220/269, 1, 273; 222/541, 529

[56] References Cited

U.S. PATENT DOCUMENTS

| | | | |
|---|---|---|---|
| 3,738,526 | 6/1973 | Zundel et al. | 220/269 |
| 3,762,597 | 10/1973 | Kaminski et al. | 220/270 |

*Primary Examiner*—George T. Hall

*Attorney, Agent, or Firm*—John J. Kowalik; Joseph E. Kerwin; William A. Dittmann

[57] ABSTRACT

An easy opening end closure is arranged and adapted to accommodate pouring of products with varying viscosities. The end panel includes a number of portions disposed to obstruct displacement of the tab and thereby limit opening of the closure to a predetermined segment thereof. The portions are deflectable to a non-obstructing position by application of sufficient force thereagainst, enabling the user to determine the size of the pour opening by controlling the number of segments opened.

9 Claims, 4 Drawing Figures

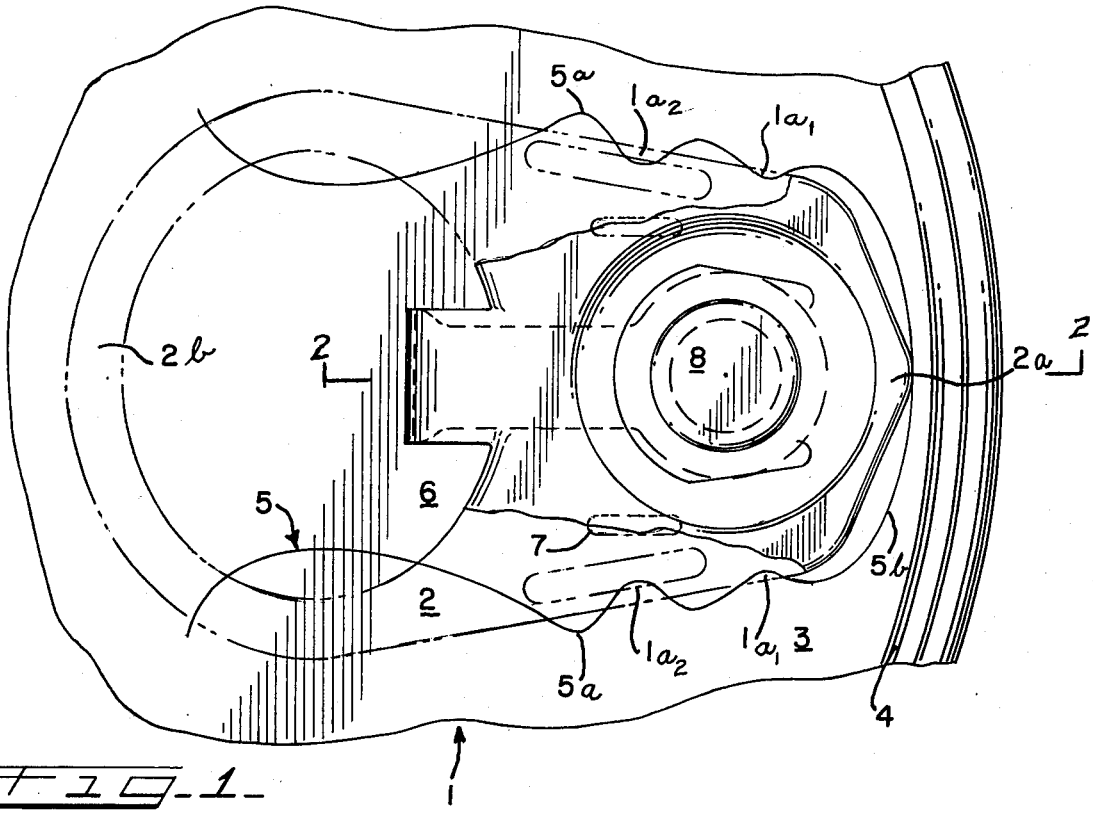
FIG. 1
FIG. 2
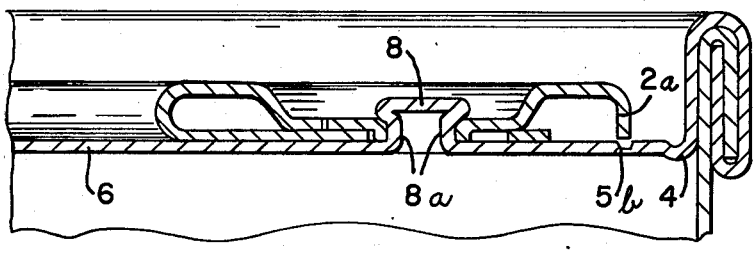

END CLOSURE WITH VARIABLE SIZE POUR OPENING

SUMMARY OF THE INVENTION

The present invention relates to end closures for containers and more particularly to a easy opening end closure for a can or similar container.

Heretofore, packaging of highly viscous materials in easy opening containers has presented problems relating to the ability to pour the material from the can. If the material is poured while at a relatively elevated temperature, whereat its viscosity is somewhat lowered, a relatively small pour opening may be sufficient. However, if the user attempts to pour the material while at a relatively lower temperature, whereat its viscosity has increased, the small pour opening may be insufficient. However, if a larger pour opening is provided and the material is poured at an elevated temperature, the material may pour more rapidly than the user desires.

Further, it has proven cumbersome to manufacture and provide several different end closures to accommodate packaging of a variety of products.

It is therefore a primary object of the present invention to provide an easy opening end closure wherein the user may control the size of the pour opening.

It is a further object to provide an end closure as described above which may be produced with a minimum of modification to existing tooling and production equipment.

The above and other objects as may hereinafter appear may be more clearly understood with reference to the specification, drawings and appended claims.

BRIEF DESCRIPTION OF THE DRAWINGS

FIG. 1 is a fragmentary top plain view of one embodiment of the end closure of the present invention.

FIG. 2 is a fragmentary cross-sectional view taken substantially along line 2—2 of FIG. 1.

DESCRIPTION OF THE PREFERRED EMBODIMENT

Figure 3:
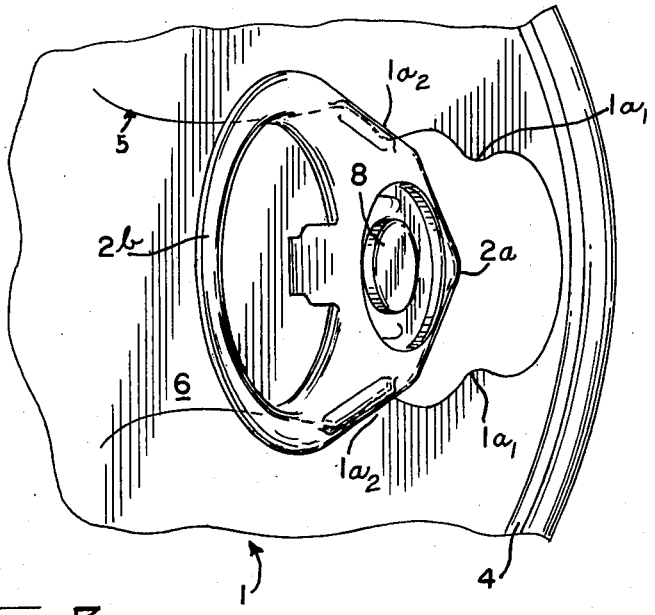
FIG. 3 is a fragmentary top plain view similar to FIG. 1, showing the end closure in a partially opened condition.

As shown in the drawings, the end closure of the present invention comprises an end panel 1, opening member 2 non-removable attached thereto, and means included in the end panel 1 and co-operative with the opening member 2 to progressively vary the force required to open the closure.

The end panel 1 comprises a central web 3 and a perpheral channel portion 4. A score line 5 is formed in the central web 3 and defines therein an openable flap or member 6. The scoreline 5 is generally U-shaped, being symmetric about a longitudinal axis of the flap 6, and comprising a pair of legs **5*a* joined by a bight 5*b***.

The opening member 2, which may be of the type described in my co-pending application Non-Obstructing End Closure, Ser. No. 684,620 is attached to the end panel 1, by a rivet 8, in a manner well known in the art substantially overlying the openable member 6, with nose portion **2*a* of the member 2 lying in close proximity to the bight 5*a* of the score line 5**.

A pair of inwardly directed rigidifying beads 7 may be formed in the flap 6 flanking the rivet 8 and extending radially inwardly from a line slightly forward of the rearward edge of the rivet shank **8*a***.

The force varying means comprises a plurality of end panel portions $1a_1$, and $1a_2$, each defined by a portion of the score line 5 offset, relative to the adjacent portions thereof, toward the longitudinal axis of the flap. The portions **1*a* are disposed in pairs spaced along the legs 5*a* of the score line 5, partially underlying the opening member 2, whereby they constitute an obstruction to displacement of the opening member 2, and thereby limit opening of the openable member 6 to a predetermined portion thereof. The portions 1*a* are themselves deflectable upon application of a predetermined force thereagainst, whereby the openable member 6** may be opened beyond the predetermined limit.

In operation, grasping portion **2*b* of the opening member 2 is lifted away from the end panel 1, causing the opening member 2 to rotate about the attaching rivet 8, and causing the nose portion 2*a* to rupture the bight portion 5*a* of the score line 5. Further displacement of the grasping portion 2*b* causes controlled tearing of the end panel 1 along the score line 5**.

The extent of the opening thus created is first limited by the pair of portions $1a_1$, nearest the end panel periphery, which obstruct continued displacement of the opening member 2. At this point, a relatively small opening, suitable for pouring of liquids of low viscosity, has been established.

If a larger opening is desired, a predetermined force is applied to the portions $1a_1$, through the opening member 2, causing the portions $1a_1$, to be deflected to a non-obstructing position. The opening member 2 may thus be moved past the portions $1a_1$, whereupon continued tearing of the score line 5, and hence opening of the closure, may be achieved through application of a reduced force to the opening member 2, until the obstruction of portion $1a_2$ is encountered. During opening, the deads 7 overcome the natural tendency of the flap 6 to bend about a transverse line touching the rearward edge of the rivet shank **8*a*. By rigidifying the flap 6**, the portion thereof radially inwardly of the natural bend line may be pushed into the container as described.

If a still larger opening is desired, this second obstacle also may be overcome in the manner above described.

It is thus seen that the portions $1a_1$ and $1a_2$ comprise "stops" whereat opening of the closure is self terminating, and whereat a directed effort is required to further enlarge the opening.

Figure 4:
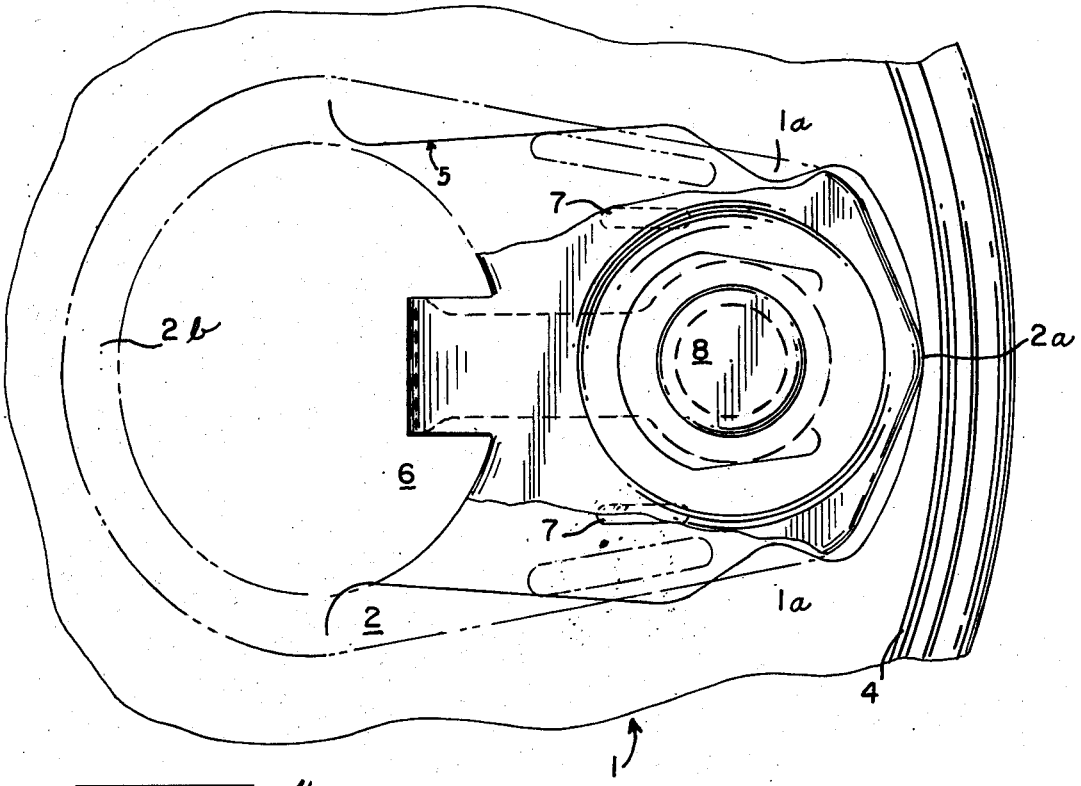
FIG. 4 is a fragmentary top plane view of a second embodiment of the end closure of the present invention.

As shown in FIG. 4, a single pair of portions **1*a***, may be employed if a lesser number of opening options is desired.

If it is desired to fully open the closure after the last obstructing portions $1a_2$ have been overcome, the opening member 2 is pulled away from the end panel 1, until the entire scoreline 5 has been sheared and the flap 6 has been moved to an unobstructing position relative to the pour opening.

I claim:

1. An easy-opening end closure for a can or similar container, arranged and adapted to permit a selection from among a succession of increasingly sized pour opening, said closure comprising an end panel, a score line formed in said end panel and defining therein an openable flap, an opening member attached to said end panel and adapted to rupture said score line and open said flap consequent to a displacement of said member, and means included in said end panel and co-operative with said opening member to progressively vary the force required to open the closure, said force varying means comprising at least one portion of said end panel, exclusive of said openable flap, disposed in obstructing relation to said opening member and limiting rupture of said score line to a predetermined portion thereof, said end panel portion being deflectable to a non-obstructing position upon application of a predetermined force thereagainst, whereby said score line may be ruptured beyond said predetermined portion thereof.

2. The end closure of claim 1, wherein said end panel portion is defined by a portion of said score line offset, relative to adjacent portions thereof, toward a longitudinal axis of said openable flap.

3. The end closure of claim 2, wherein said score line is symmetric about said longitudinal axis.

4. The end closure of claim 3, wherein said score line is substantially U-shaped, comprising two legs connected by a bight, and said force limiting means comprises a plurality of pairs of said portions, said pairs being spaced along said legs.

5. The end closure of claim 4, wherein said flap is provided with means rigidifying a portion thereof said portion extending radially inwardly from the point of attachment of said opening member to said end panel.

6. An easy-opening end closure for a can or similar container, arranged and adapted to provide an opening selectively having one of a finite number of predetermined configurations, said closure comprising an end panel, a score line formed in said end panel and therein defining an openable flap, and an opening member attached to said openable flap and having a nose adapted for rupturing said score line to open the closure, said opening member substantially overlying said openable flap, the end panel exclusive of said openable flap including at least one portion underlying said opening member, said portion being disposed to obstruct displacement of said opening member and thereby to limit opening of said openable member to a predetermined portion thereof, said portion being deflectable to a non-obstructing portion upon application of a predetermined force thereagainst, whereby said openable member may be opened beyond said predetermined portion.

7. The end closure of claim 6, wherein said end panel portions are symmetrically disposed relative to a longitudinal axis of said openable member.

8. The end closure of claim 7, wherein said openable member is substantially U-shaped, comprising two legs connected by a bight, and said portions are disposed in pairs spaced along said legs.

9. The end closure of claim 7, wherein said openable member is provided with means rigidifying a portion thereof, said portion extending radially inwardly from the point of attachment of said opening member to said end panel.

* * * * *